US005083585A

United States Patent [19]

Rheinganz

[11] Patent Number: 5,083,585

[45] Date of Patent: Jan. 28, 1992

[54] CLAMP ELEMENT FOR A WEFT PICKING ELEMENT

[75] Inventor: Ursula Rheinganz, Laupen, Switzerland

[73] Assignee: Sulzer Brothers Limited, Winterthur, Switzerland

[21] Appl. No.: 690,726

[22] Filed: Apr. 24, 1991

[30] Foreign Application Priority Data

May 16, 1990 [CH] Switzerland ..... 01659/90

[51] Int. Cl.[5] ..... D03D 47/20

[52] U.S. Cl. ..... 139/448; 139/196.2; 139/438

[58] Field of Search ..... 24/557; 139/438, 439, 139/170.3, 186, 187, 196.2, 196.3, 216, 448

[56] References Cited

U.S. PATENT DOCUMENTS 1,316,551 9/1919 Holt ..... 139/186
3,579,751 5/1971 Jonckheene ..... 24/557 X
3,857,419 12/1974 Mackie ..... 139/448
4,149,299 4/1979 Welsh ..... 24/557 X

FOREIGN PATENT DOCUMENTS 2061194 3/1972 Fed. Rep. of Germany .
2285481 4/1976 France .
2320370 3/1977 France .
2447988 8/1980 France .

*Primary Examiner*—Andrew M. Falik
*Attorney, Agent, or Firm*—Kenyon & Kenyon

[57] ABSTRACT

A fork-like clamp element is provided for a weft yarn clamp for use in a rapier loom. The fork-like clamp element includes a clamping tongue, a securing part for securement in a rapier giver or rapier taker and a presser opposite the securing part. The securing part includes a resiliently flexible zone so that upon movement of the presser towards the securing part, the zone is able to yield resiliently and, thus, allow the tongue to move away from an opposite clamp element for release of a weft yarn therebetween.

12 Claims, 1 Drawing Sheet

Fig.1a
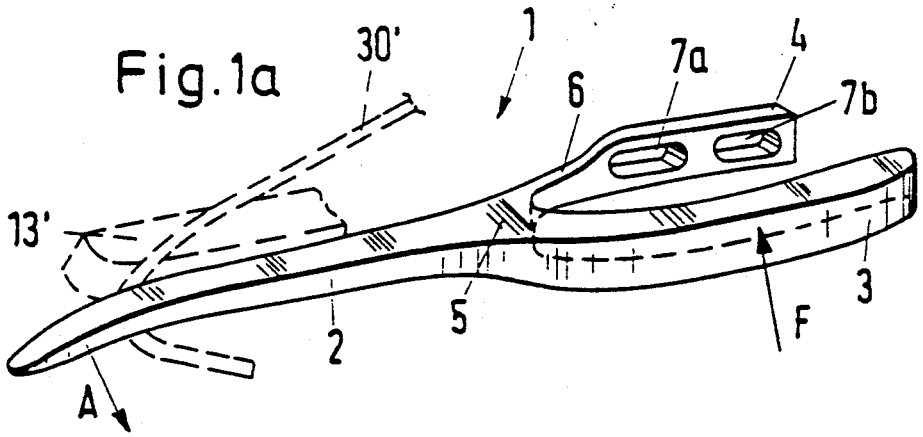
Fig.1b
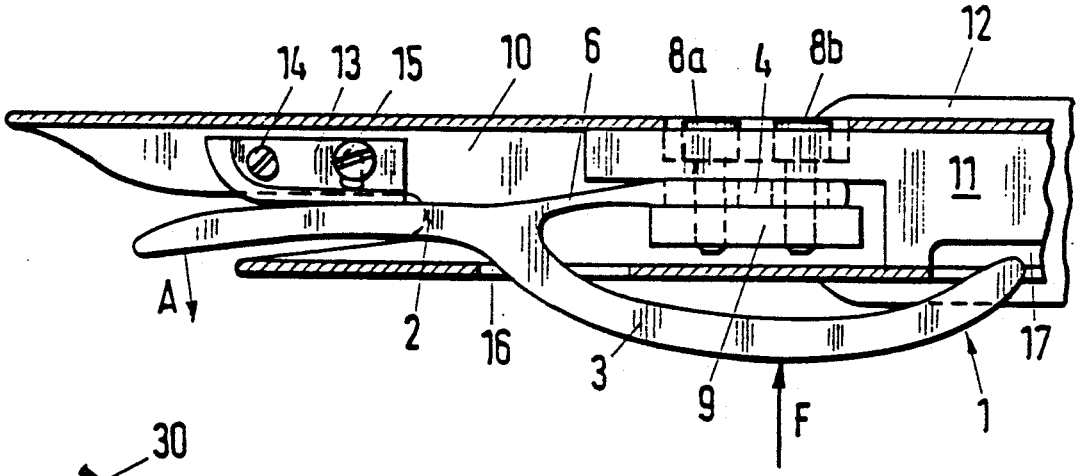
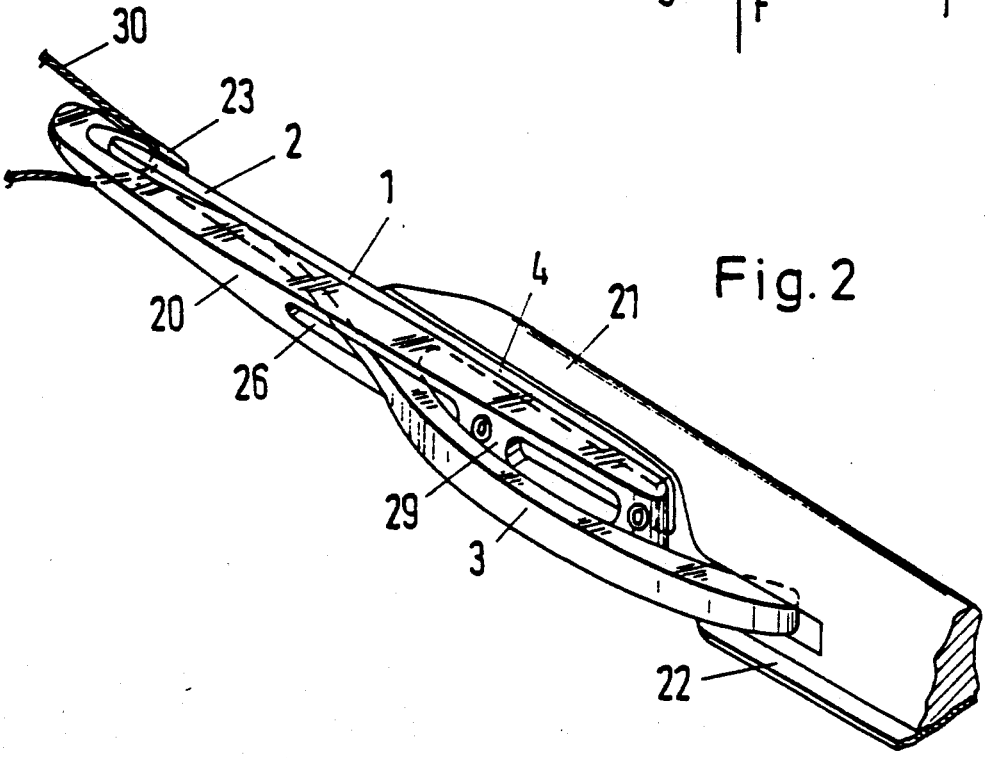
Fig. 2

CLAMP ELEMENT FOR A WEFT PICKING ELEMENT

This invention relates to a clamp element for a weft picking element of a rapier loom. More particularly, this invention relates to a weft yarn clamp for a rapier loom.

As is known, rapier looms have been constructed with picking elements in the form of a giver rapier and a taker rapier. The giver rapier serves to pick a weft yarn presented thereto into the center of a shed where a taker rapier takes over the weft yarn. To this end, clamps have been utilized in order to grip the yarn to the respective rapier for conveyance. Generally, such clamps have had at least two elements, for example, two clamping jaws which bound a gap in which the yarn can be clamped. In addition, such clamp elements have been pressed together by means of a spring force.

Depending upon the spring force, the weft yarn clamps for the rapier looms can be separated into two kinds. In a first kind, in order to open the clamp by force, at least one of the two clamp elements moves in the direction of the applied force. In the second kind, the forces are transmitted by way of a linkage so that, for example, the opening movement of a clamp element occurs in the opposite direction to that of the applied force. The best kind of clamp to use depends upon various factors related to the specific construction of the picking element. Clamps of the first kind are described in Swiss Patent 592,761 and German Patent 2 947 399 and are mainly used for giver rapiers wherein the clamps of the second kind are described in German Patent 3 033 201 and are preferred for taker rapiers.

Other examples of weft yarn clamping elements which employ spring biased pivotally mounted clamp elements are described in German Patent 2 061 194 and French Patents 2 285 481; 2 320 370; and 2 447 988.

Generally the picking elements of rapier looms suffer from many problems, two of which will be discussed herein. First of all the rapiers are required to be of very reduced weight for the sake of rapid acceleration. Second, the rapiers should be constructed so that fly which may impair serviceability can be removed readily. These two requirements are particularly important in the case of picking elements having clamps of the second kind since the force deflection for opening such clamps has led to constructions which have articulated sprung linkages and are therefore heavy and susceptible to soiling.

Accordingly, it is an object of the invention to provide a weft yarn clamp of relatively reduced weight which is not prone to collecting fly.

It is another object of the invention to provide a light weight clamp element for a weft picking element of a rapier loom.

It is another object of the invention to avoid the accumulation of fly and like debris in a weft yarn clamp for a rapier loom during operation.

Briefly, the invention provides a clamp element for a weft picking element of a rapier loom which comprises a clamping tongue having a base at one end, a securing part which extends from the base with a fixing zone and a resiliently flexible zone between the tongue base and the fixing zone and a presser which extends from the base in coplanar relation to the securing part in order to define a unitary fork-like member with the tongue and securing part. The construction of the clamp element is such that upon movement of the presser towards the securing part, the resiliently flexible zone of the securing part yields resiliently.

The clamp element may also be associated with a second clamp element opposite the clamping tongue so as to form a weft yarn clamp of the second kind wherein the weft yarn clamp has a limited number of components, is relatively light in weight and is relatively easy to clean.

The presser of the clamp element may be disposed to have a force applied thereon laterally of the picking element or to the top of the picking element.

The weft yarn clamp can be incorporated in a given rapier as well as a taker rapier. In the first case, the securing part of the fork-like clamp element is secured in a head of the giver rapier. In this regard, the securing part may also be fixed at adjustable points relative to the head so as to change the effective length of the resiliently flexible zone of the securing part and, thus, the spring rate. In the latter case, wherein a taker rapier has a taker tip, a hook on the tip and a securing member for a picking tape, the clamping tongue of the fork-like clamp element is positioned opposite the hook to form a nip while the securing part is secured to the securing member of the taker rapier. In this embodiment, the presser may extend through the taker tip.

The clamp element can be cleaned normally when the rapiers are in withdrawn positions outside a shed. Stuck fibers in the clamping nip can be exposed by pressing the element. Thereafter, the stuck fibers can be removed by blowing or suction nozzles, for example.

These and other objects and advantages of the invention will become more apparent from the following detailed description taken in conjunction with the accompanying drawings wherein:

FIG. 1*a* illustrates a perspective view of a fork-like clamp element constructed in accordance with the invention;

FIG. 1*b* illustrates a plan view of the clamp element of FIG. 1*a* secured in place in a giver rapier in accordance with the invention; and FIG. 2 illustrates a modified fork-like clamp element mounted in place on a taker rapier in accordance with the invention.

Referring to FIG. 1*a*, the clamp element is of fork-like shape having a clamping tongue 2 defining a handle of the fork as well as a presser 3 and a securing or fixing part 4 which together define two arms of the fork-like clamp element.

The clamping tongue 2 has a base 5 at one end and cooperates with a second clamp element 13' shown in dotted lines so as to form a nip for clamping a weft yarn 30'.

The presser 3 and securing part 4 extend from the base 5 of the tongue and are disposed in coplanar relation with each other. As indicated, the presser 3 is of arcuate shape.

The securing part 4 has a fixing zone which includes a pair of elongated slots *7a*, *7b* for securing the clamp element in place as described below. In addition, the securing part 4 has a resiliently flexible zone 6 between the base 5 and the fixing zone.

Upon the application of a force F on the presser 3, the presser 3 moves towards the securing part 4 so that the resiliently flexible zone 6 yields resiliently. In this respect, the flexible zone 6 is made of a smaller cross-section than the presser 3.

Referring to FIG. 1*b*, wherein like reference characters indicate like parts as above, the fork-like clamp element can be incorporated in a giver rapier. To this end, the giver rapier has a giver head 10 (shown with the top part cut away), a base plate 11 and a picking tape 12 secured to the base plate 11.

As shown, the securing part 4 of the clamp element 1 is sandwiched between the base plate 11 and a clamping plate 9 by means of a pair of screws 8*a*, 8*b*. As indicated, the screws 8*a*, 8*b* are threaded into the clamping plate 9 and are received in a recess of the base plate 11. The threaded shanks of the screws 8*a*, 8*b* pass through the elongated slots 7*a*, 7*b* of the clamp element 1 to permit the clamp element 1 to be fixed at different point within the rapier head 10. The tongue 2 is disposed opposite a clamp element 13 which is secured in the head 10 by means of screws 14, 15 in order to form a nip for receiving a weft yarn, for example in a manner as illustrated in FIG. 1*a*.

As illustrated, the presser 3 extends out of the head 10 through a lateral aperture 16 in a casing wall of the head 10 and can thus have a force F applied thereon. The application of the force F leads to a force couple which acts on the arms 3, 4 of the clamp element 1 and applies a bending torque to the flexible zone 6. The bending of this zone 6 causes the tongue 2 to deflect in the direction indicated by the arrow A, that is, the clamp opens.

The force F also causes a resilient deformation of the presser 3 but such deformation does not affect the deflection of the tongue 2. Advantageously, therefore, the flexible zone 6 of the securing part 4 is so dimensioned that the force F is mainly effective in the flexible zone 6. Correspondingly, the flexible zone 6 has a cross-section which is smaller, for example, by half, than the cross-section of the presser 3. Advantageously also, the presser 3 is relatively large in order to provide a large pressing surface in order to produce a reduced surface pressure when the clamp opens.

The spring rate of the flexible zone 6 depends upon the effective length over which the zone 6 is flexible. This effective length can be varied if, for example, the elongated slots 7*a*, 7*b* are elongated in the direction of the axis of the securing part 4. Thus, when the screws 8*a*, 8*b* and the clamping member 9 are moved further towards the base 5, the effective length of the resilient zone 6 decreases and the spring rate increases. Alternatively, screw threads can be provided in the securing part 4 rather than slots. In this case, the displaceable feature can be provided by means of slots in the base plate 11. Other forms of fixation are also possible, such as a sandwich-like clamping between the base plate 11 and a clamping member corresponding to the clamping plate 9.

In order to avoid mispicks of the giver rapier, the tongue 2 is prestressed into clamping engagement with the clamp element 13. The resulting clamping force can be made adjustable if the fixing position of the clamp element 13 is variable as shown by way of example in FIG. 1*b* wherein the clamp element 13 is provided with a slot for receiving the screw 15 such that the clamp element 13 can be pivoted to a limited extent about the axis of the other screw 14. Another possible form of adjustment is to use an eccentric pin instead of the screw 15 together with a corresponding adaptation of the associated slot or aperture in the clamp element 13.

When the giver rapier withdraws from a shed, there is a risk that the presser 3 which projects from the head 10 may tear warp yarns. This risk can be obviated if the presser 3 is arcuate and has a rear end screened by a recess 17 in the rapier casing 10 as illustrated.

Referring to FIG. 2, wherein like reference characters indicate like parts as above, the clamp element 1 may be used very satisfactorily for the clamp of a taker rapier. To this end, the taker rapier is constructed with a taker tip 20, a securing member 21 to which a picking tape 22 is secured and a rigid hook 23 which extends from the taker tip 20.

As illustrated, the tongue 2 of the clamp element 1 is provided opposite the hook 23 in order to form a nip for grasping a weft yarn 30. In this way, the hook 23 serves as a second clamp element for the weft yarn 30.

The taker tip 20 is provided with an aperture 26 to permit the presser 3 to pass through and thus facilitate a compact connection between the tip 20 and the clamp element 1. The tip 20 also has a rear part 29 to which the securing part 4 of the clamp element 1 is secured, for example by a pair of rivets or screws.

In this embodiment, when a force is applied on the presser 3, the tongue 2 moves away from the hook 23 so as to release the weft yarn 30. In order to accommodate the deflection of the tongue 2, the taker tip 20 is hollowed or recessed so as to receive the tongue 2.

In the various embodiments described above, the weft yarn clamps can be opened outside a shed in order to be cleaned. The clamps must also be openable in order to be able to release the weft yarn. To this end, the yarn is released from the taker rapier by means of an auxiliary device (not shown) after picking. Alternatively, at yarn transfer from the giver rapier to the taker rapier, the clamps are operated by levers (not shown) which are pivoted into the shed between the warp yarns.

Basically, the same fork-like clamp element 1 can be used for both a giver rapier and a taker rapier of a rapier loom provided that the constructions of the picking elements are suitable. Since the two picking elements have to perform different operations, a unitary clamp element is a compromise solution for the weft yarn clamp. An approximation to an optimal clamp can be achieved by a minor adaptation, for example, of the clamp tongue to the different requirements using an identical clamp element 1 for both the giver rapier and the taker rapier helps to standardize loom construction.

The invention thus provides a clamp element of light weight construction which facilitates the construction of light weight rapier takers and givers. Further, the invention provides a weft yarn clamp which can be readily cleaned from time to time.

What is claimed is:

1. A clamp element for a weft picking element for a rapier loom comprising a clamping tongue having a base at one end;

a securing part extending from said base and having a fixing zone and a resiliently flexible zone between said base and said fixing zone; and a presser extending from said base in coplanar relation to said securing part to define a unitary fork-like member with said tongue and said securing part whereby upon movement of said presser towards said securing part said resiliently flexible zone yields resiliently.

2. A clamp element as set forth in claim 1 wherein said presser is arcuate.

3. A clamp element as set forth in claim 1 wherein said flexible zone has a smaller cross-section than said presser.

4. A clamp element as set forth in claim 1 wherein said fixing zone includes at least a pair of elongated slots for receiving fixing means.

5. A weft yarn clamp comprising a first clamp element; and a fork-like clamp element having a clamping tongue opposite said first clamp element to form a nip therewith and having a base at one end, a securing part extending from said base with a fixing zone and a resiliently flexible zone between said base and said fixing zone and a presser extending from said base whereby upon movement of said presser towards said securing part said flexible zone yields resiliently to move said tongue away from said first clamp member.

6. A weft yarn clamp as set forth in claim 5 wherein said tongue is prestressed into clamping engagement with said first clamp element.

7. In combination, a giver rapier having a head;

a first clamp element secured in said head; and a fork-like clamp element having a clamping tongue opposite said first clamp element to form a nip therewith and having a base at one end, a securing part extending from said base with a fixing zone secured in said head and a resiliently flexible zone between said base and said fixing zone, and a presser extending from said base whereby upon movement of said presser towards said securing part said flexible zone yields resiliently to move said tongue away from said first clamp member.

8. The combination as set forth in claim 7 wherein said fixing zone includes at least a pair of elongated slots and which further comprises at least one bolt extending through one of said slots to secure said fork-like clamp element to said rapier head.

9. The combination as set forth in claim 8 wherein said flexible zone has a smaller cross-section than said presser.

10. The combination as set forth in claim 7 wherein said securing part is fixable at different points relative to said head.

11. In combination, a taker rapier having a taker tip, a hook on said tip and a securing member for a picking tape; and a fork-like clamp element having a clamping tongue opposite said hook to form a nip therewith and having a base at one end, a securing part extending from said base with a fixing zone secured to said securing member and a resiliently flexible zone between said base and said fixing zone, and a presser extending from said base whereby upon movement of said presser towards said securing part said flexible zone yields resiliently to move said tongue away from said first clamp member.

12. The combination as set forth in claim 1 wherein said presser extends through said taker nip.

* * * * *

UNITED STATES PATENT AND TRADEMARK OFFICE

CERTIFICATE OF CORRECTION

PATENT NO. : 5,083,585

DATED : January 28, 1992

INVENTOR(S) : Rheinganz

It is certified that error appears in the above-identified patent and that said Letters Patent is hereby corrected as shown below:

Column 2, line 29, change "pressing the element" to --pressing the presser in order to separate the clamping tongue from a clamp element--

Column 4, line 42, change "requirements using an" to --requirements. Using an-- line 45, change "element of light" to --element of light- -- line 47, change "of light weight" to --of lightweight-- line 67, change "cross-section" to --cross section--

UNITED STATES PATENT AND TRADEMARK OFFICE

CERTIFICATE OF CORRECTION

PATENT NO. : 5,083,585

DATED : January 28, 1992

INVENTOR(S) : Rheinganz

It is certified that error appears in the above-indentified patent and that said Letters Patent is hereby corrected as shown below:

Column 6, line 1, change "part said flexible" to --part, said flexible-- line 9, change "a smaller cross-section" to --a smaller cross section-- line 25, change "part said flexible" to --part, said flexible--

Signed and Sealed this

Fourteenth Day of September, 1993

Bruce Lehman

*Attest:*

BRUCE LEHMAN

*Attesting Officer*

*Commissioner of Patents and Trademarks*